United States Patent [19]

Ishibashi

[11] Patent Number: 4,551,053

[45] Date of Patent: Nov. 5, 1985

[54] SHEET SUB-STACK SEPARATING AND FEEDING APPARATUS

[75] Inventor: Teruhiko Ishibashi, Yoshida, Japan

[73] Assignee: Fuji Photo Film Co. Ltd., Tokyo, Japan

[21] Appl. No.: 614,987

[22] Filed: May 29, 1984

[51] Int. Cl.[4] ..... B65H 33/02

[52] U.S. Cl. ..... 414/114; 271/42; 414/907

[58] Field of Search ..... 414/112, 114, 115, 117, 414/907; 271/42

[56] References Cited

U.S. PATENT DOCUMENTS

| | | | |
|---|---|---|---|
| 3,174,633 | 3/1965 | Stevens | 414/114 |
| 3,176,859 | 4/1965 | Prager | 414/114 |
| 3,966,059 | 6/1976 | Sase | 414/114 |
| 4,313,703 | 2/1982 | Fabrig | 414/115 |

FOREIGN PATENT DOCUMENTS

| | | | |
|---|---|---|---|
| 2117742 | 10/1983 | United Kingdom | 414/114 |

*Primary Examiner*—Leslie J. Paperner
*Attorney, Agent, or Firm*—Pasquale A. Razzano

[57] ABSTRACT

A sheet sub-stack separating and feeding apparatus comprises a device for holding down sheets independently laid one upon the other in a stack, a device for detecting the level of a sheet in a predetermined position as numbered consecutively from above, a sheet sub-stack raising member standing face to face with a side end face of the stack for horizontal and vertical movements, and a device for grasping a predetermined number of sheets as one sub-stack and adapted for horizontal and vertical movements. The sheet sub-stack raising member is moved to the level detected by the sheet level detecting device, inserted under the top sub-stack while it is held down, and then moved up to raise an end portion of the stack. The forward end portion of the sheet sub-stack raising member is then swung down to hold down the sheets under the sub-stack. The sheet sub-stack grasping device is then moved horizontally to grasp the end portion of the sub-stack and to separate the sub-stack from the stack.

12 Claims, 2 Drawing Figures

SHEET SUB-STACK SEPARATING AND FEEDING APPARATUS

BACKGROUND OF THE INVENTION

1. Field of the Invention

This invention relates to a sheet sub-stack separating and feeding apparatus for taking out sheet sub-stacks each comprising a predetermined number of sheets from a stack of the sheets one at a time.

2. Description of the Prior Art

In many cases, sheet materials such as paper sheets and thin metal plates are fabricated, for example, by cutting a web of these materials in predetermined lengths, and then laid one upon the other to form a stack by matching the positions for use in the next process such as sheet loading or packaging. When packaging or the like is carried out after the sheet materials are disposed in a stack, it is necessary to take out sheet sub-stacks each comprising a predetermined number of sheets (for example, one packaging unit of sheets in the case of packaging) from the sheet stack one at a time.

As apparatuses for taking out sheet sub-stacks each comprising a predetermined number of sheets from a sheet stack one at a time as described above, there has heretofore been known an apparatus wherein the uppermost sheet sub-stack of the sheet stack is pushed out approximately horizontally by a pusher, and the pushed-out sheet stack is placed on a conveying means such as a roller conveyor and separated from the sheet stack. However, in the sheet sub-stack separating and feeding apparatus using the pusher, it is necessary in advance to bundle the predetermined numbers of sheets constituting sub-stacks by use of tapes or the like and lay the sub-stacks one upon the other so that the sheets constituting each sub-stack will not be thrown out of order when they are pushed out by the pusher. Bundling the sheets at the time of stacking the sheets one by one requires considerable labor, a mechanism or a means therefor, and a longer time for stacking the sheets.

SUMMARY OF THE INVENTION

The primary object of the present invention is to provide an apparatus for separating and feeding sheet sub-stacks, which takes out a predetermined number of sheets together as a sheet sub-stack from a sheet stack comprising the sheets simply stacked one upon the other without being bundled, thereby eliminating the necessity of bundling the sheets in units of the predetermined number when the sheets are stacked.

Another object of the present invention is to provide an apparatus for separating and feeding sheet sub-stacks, which eliminates the need for bundling the sheets, thus realizing a saving in labor and expense, and shortens the time required for stacking the sheets.

The apparatus for separating and feeding sheet sub-stacks in accordance with the present invention comprises:

(i) a sheet sub-stack holding-down means for holding a stack of sheets, which are independently laid one upon the other, from above said stack at a position spaced inwardly from a side end face of said stack, (ii) a level detecting means for detecting the level of a sheet in a predetermined position as numbered consecutively from the uppermost sheet material of said stack, (iii) a sheet sub-stack, raising member positioned in face-to-face relation to said side end face of said stack for movement in an approximately horizontal direction between an intervening position where it intervenes in said stack and a retracted position away from said stack and for movement in the vertical direction, (iv) a sheet sub-stack grasping means for grasping a predetermined number of said sheets as one sub-stack from the side of said side end face of said stack, said sheet sub-stack grasping means being capable of moving in the vertical direction and in an approximately horizontal direction, (v) a raising member driving device for adjusting the level of said sheet sub-stack raising member in said retracted position so that said sheet sub-stack raising member stands face to face with a space between said sheet in said predetermined position as numbered consecutively from the uppermost sheet of said stack, which is detected by said level detecting means, and the sheet under said sheet in said predetermined position, for feeding said sheet sub-stack raising member in an approximately horizontal direction up to said intervening position, for lifting said sheet sub-stack raising member by a predetermined distance in said intervening position, and for then moving down said sheet sub-stack raising member to a position for holding down the sheet under said sheet in said predetermined position, (vi) a grasping means driving device for moving said sheet sub-stack grasping means to a position for grasping a side end portion of the sheet sub-stack comprising the predetermined number of said sheets, said side end portion being raised by said sheet sub-stack raising member on the side of said side end face of said stack, for causing said sheet sub-stack grasping means to grasp said side end portion of said sheet sub-stack, and for then moving said sheet sub-stack grasping means in an approximately horizontal direction to separate said sheet sub-stack from the upper section of said stack, and (vii) a sheet sub-stack holding-down means controlling device for adjusting said sheet sub-stack holding-down means to a stack holding-down position at least as long as said sheet sub-stack raising member is moved in contact with said stack.

In the apparatus for separating and feeding sheet sub-stacks in accordance with the present invention, sheet materials disposed in a stack are held down by the sheet sub-stack holding-down means until a predetermined number of sheets at the upper portion of the stack are raised by the sheet sub-stack raising member as a sheet sub-stack at a side end portion thereof and grasped by the sheet sub-stack grasping means. Therefore, the sheets are grasped by the sheet sub-stack grasping means in a well-ordered sheet sub-stack. Accordingly, it becomes unnecessary to bundle in advance the sheet materials in units of a predetermined number by use of a tape or the like as in the case of the conventional apparatus using a pusher. Thus the present invention eliminates the need to devote labor and expense for bundling the sheet materials and shortens the time required for stacking the sheet materials.

DESCRIPTION OF THE PREFERRED EMBODIMENTS

The present invention will hereinbelow be described in further detail with reference to the accompanying drawings.

Figure 1:
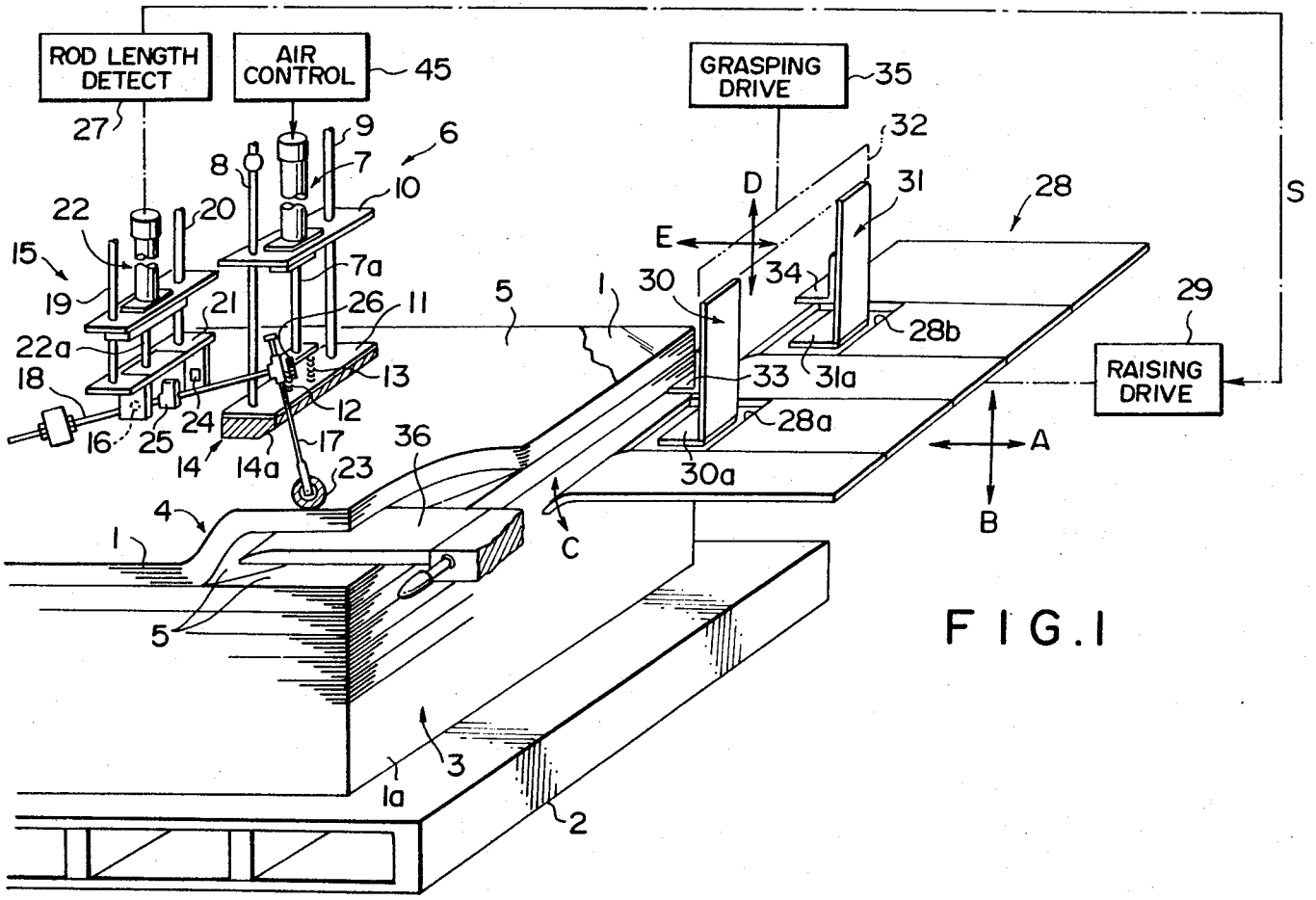
FIG. 1 is a schematic view showing an embodiment of the apparatus for separating and feeding sheet sub-stacks in accordance with the present invention.

FIG. 1 schematically shows an embodiment of the apparatus in accordance with the present invention. By way of example, the sheet materials handled by this embodiment are aluminium sheets having a photographic material layer applied on the surfaces. Sheets 1 are laid one upon the other in a stack 3 at a stacking position on a pallet 2. The apparatus of this embodiment is constructed for use in feeding the sheets 1 as sheet sub-stacks 4 each consisting of a predetermined number of the sheets 1 corresponding to one packaging unit sequentially from the upper portion of the stack 3 to the next packaging process. In the stack 3, two protective sheets 5 are interleaved for each packaging unit so that each of the protective sheets 5 is positioned on and under each sheet sub-stack 4 for protecting the sheet sub-stack 4 when the sheet sub-stack 4 is separated from the stack 3.

A sheet sub-stack holding-down means 6 is installed above the stack 3 at a position spaced inwardly of the stack 3 (i.e. toward the center thereof) from a side end face 1*a* of the stack 3 (i.e. the right side end face thereof in FIG. 1). The sheet sub-stack holding-down means 6 comprises an air cylinder 7 vertically positioned with a piston rod 7*a* thereof facing down, and a holding-down member 11 supported on the end of the piston rod 7*a* via shock-absorbing springs 12 and 13. The holding-down member 11 is secured to guide rods 8 and 9 which are inserted through a plate 10 so that holding-down member 11 can be moved vertically guided by the guide rods 8 and 9. To the bottom of the holding-down member 11 is secured a rubber piece 14 having an end face 14*a* on the side of the side end face 1*a* of the stack 3. The lower portion of the end face 14*a* is curved convexly.

On the left side of the sheet sub-stack holding-down means 6 in FIG. 1 is positioned a level detecting means 15 which comprises an arm 18 adapted for swinging around a supporting point 16 and provided with a roller shaft 17 supported at an end portion of the arm 18, and an air cylinder 22 having a piston rod 22*a*. On the lower end of the piston rod 22*a* is supported a plate 21 which supports the arm 18 and which is guided by guide rods 19 and 20 for vertical movement. A roller 23 is supported on an end of the roller shaft 17, and the level detecting means 15 is positioned such that the roller 23 contacts a corner portion of the uppermost protective sheet 5 on the side of the side end face 1*a* of the stack 3 by the weight of the roller 23 from above the stack 3. By way of example, the plate 21 and the arm 18 adapted for swinging with respect to the plate 21 as described above are respectively provided with a photoelectric device comprising a light projector 24 and a light receiver 25 so that a predetermined swinging position of the arm 18 can be detected by the photoelectric device. The length of the portion of the roller shaft 17 downwardly projected from the end of the arm 18 can be adjusted by loosening a fixing screw 26. The length of projection of the piston rod 22*a* of the air cylinder 22 is detected by a rod length detecting device 27. Therefore, the level of the upper surface of the protective sheet 5 in contact with the roller 23 can be detected by driving the air cylinder 22 until the photoelectric device detects that the arm 18 is in a specified swinging position, and then by detecting the length of projection of the piston rod 22*a*.

In a position standing face to face with the side end face 1*a* of the stack 3 is installed a sheet sub-stack raising member 28 having a forward end portion (i.e. a left end portion in FIG. 1) bent downwardly and apertures 28*a* and 28*b* positioned in the vicinity of the forward end portion. The sheet sub-stack raising member 28 can be moved in an approximately horizontal direction as indicated by the arrow A between a retracted position spaced from the stack 3 and an intervening position where the sheet sub-stack raising member 28 intervenes in the stack 3, and in a vertical direction as indicated by the arrow B. Further, the forward end portion of the sheet sub-stack raising member 28 can be swung vertically as indicated by the arrow C. Movements of the sheet sub-stack raising member 28 in the directions as indicated by the arrows A, B and C are driven by a raising member driving device 29 constituted, for example, by a known device such as an air cylinder device.

Above the sheet sub-stack raising member 28 is positioned a sheet sub-stack grasping means 32 having fingers 30 and 31 and capable of being moved in the vertical direction as indicated by the arrow D and in an approximately horizontal direction as indicated by the arrow E. The fingers 30 and 31 are respectively provided at their lower end portions with claw members 30*a* and 31*a* facing the stack 3, and with chuckers 33 and 34 standing face to face with the claw members 30*a* and 31*a* from above thereof and moved vertically with respect to the claw members 30*a* and 31*a* by a driving device (not shown). Movements of the sheet sub-stack grasping means 32 in the directions as indicated by the arrows D and E are driven by a grasping means driving device 35 constituted, for example, by a known device such as an air cylinder device.

Figure 2:
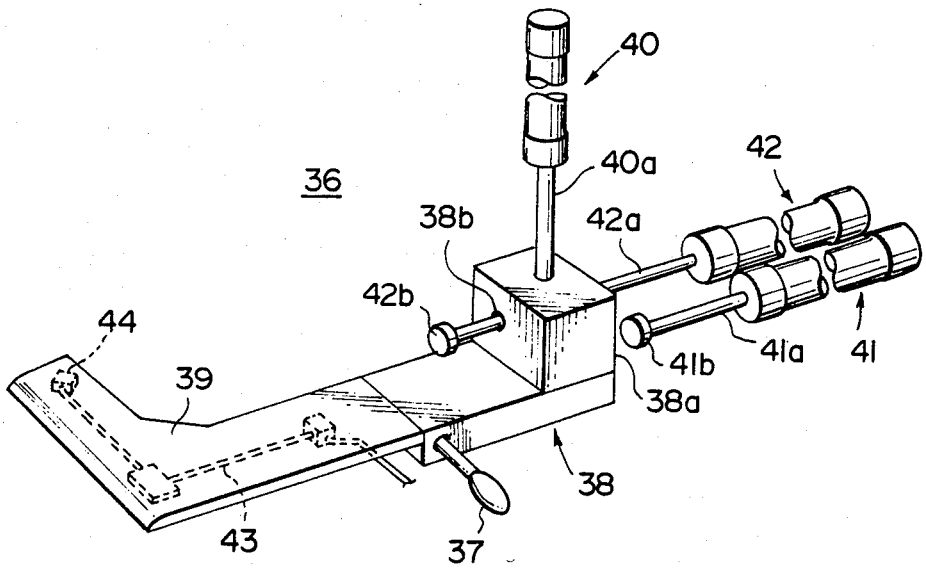
FIG. 2 is a perspective view showing in detail a part of the apparatus of FIG. 1.

An auxiliary sheet sub-stack raising member 36 is positioned in face-to-face relation to a corner portion of the stack 3 on the lateral side of the sheet sub-stack raising member 28. As shown in detail in FIG. 2, the auxiliary sheet sub-stack raising member 36 comprises a base section 38 provided with a handle 37 secured to a side portion thereof, an approximately L-shaped edge section 39 having a rear end portion secured to the forward end portion of the base section 38 and a forward end portion facing the center of the stack 3, a vertical movement driving cylinder 40 having a piston rod 40*a* secured to the upper portion of the base section 38, a forward movement driving cylinder 41 and a rearward movement driving cylinder 42 positioned at the rear of the base section 38. The cylinders 40, 41 and 42 may be air cylinders. The forward movement driving cylinder 41 is positioned so that a contact portion 41*b* secured to the end of a piston rod 41*a* of the cylinder 41 can be contacted with a rear end face 38*a* of the base section 38. The rearward movement driving cylinder 42 has a piston rod 42*a* inserted into a through hole 38*b* of the base section 38 such that, when the piston rod 42*a* is contracted, a contact portion 42*b* secured to the end of the piston rod 42*a* pulls the base section 38 rearwardly (rightwardly in FIGS. 1 and 2). In the edge section 39 is housed a compressed-air pipe 43 connected, for example, to an air compressor. To the forward end of the pipe 43 is connected a nozzle 44 for jetting compressed air from the forward end portion of the edge section 39 to the center of the stack 3. The forward side end portion of the edge section 39 is shaped such that the upper surface thereof is gradually curved towards the lower surface thereof.

The apparatus constructed as described above is operated as described below. When the sheets 1 laid one upon the other in the stack 3 on the pallet 2 are separated as sheet sub-stacks each comprising the sheets 1 in a number corresponding to a predetermined packaging unit from the stack 3, the pallet 2 supporting the stack 3 is first positioned as shown in FIG. 1. Then, a compressed-air controlling device 45 for controlling the movement of the holding-down member 11 by use of compressed air fed to the air cylinder 7 is activated to extend the piston rod *7a* of the air cylinder 7. As a result, the holding-down member 11 supported on the end of the piston rod *7a* holds the stack 3 from above thereof at a position spaced inwardly from the side end face *1a* of the stack 3. Since the rubber piece 14 is secured to the bottom of the holding-down member 11 and the holding-down member 11 is supported on the end of the piston rod *7a* via the springs 12 and 13, no large shock is applied to the sheets 1 via the uppermost protective sheet 5, and the sheets 1 and the protective sheet 5 are thereby prevented from being damaged.

Thereafter, the corner portion of the uppermost sheet sub-stack 4 comprising the sheets 1 in a number corresponding to one packaging unit (i.e. the corner portion thereof standing face to face with the auxiliary sheet sub-stack raising member 36) is grasped together with the upper and lower protective sheets 5 by an operator, and slightly raised away from the sheets 1 positioned under the sheet sub-stack 4. After the sheet sub-stack 4 is slightly raised, the handle 37 of the auxiliary sheet sub-stack raising member 36 is gripped by the operator and the auxiliary sheet sub-stack raising member 36 is moved forwardly by the operator until the forward side end portion edge section 39 is inserted under the sheet sub-stack 4. Then, the forward movement driving cylinder 41 is activated, for example, by pushing an operating pushbutton, so that the piston rod 41*a* is extended. Thus the auxiliary sheet sub-stack raising member 36 is pushed by the piston rod 41*a* and moved forwardly until the edge section 39 enters deeply into the stack 3. When the edge section 39 is inserted into the stack 3, compressed air is jetted from the nozzle 44 housed in the edge section 39. Therefore, the protective sheets 5 or the sheets 1 now positioned on the upper and lower sides of the edge section 39 are opened up and down by compressed air, and the edge section 39 can be readily inserted into the stack 3 without being obstructed by the protective sheets 5 or the sheets 1.

The forward movement driving cylinder 41 is stopped after the piston rod 41*a* is extended by a predetermined distance, and then the vertical movement driving cylinder 40 is activated to contract the piston rod 40*a*. As a result, the auxiliary sheet sub-stack raising member 36 is moved up, and the sheet sub-stack 4 is further raised by the edge section 39 of the auxiliary sheet sub-stack raising member 36 as shown in FIG. 1. When the sheet sub-stack 4 is thus raised, the bottom surface of the sheet sub-stack 4 (the bottom surface of the lower protective sheet 5 of the sheet sub-stack 4) comes into contact with the forward side end portion of the edge section 39. However, since the forward side end portion of the edge section 39 is curved as described above, the sheets 1 and the lower protective sheet 5 of the sheet sub-stack 4 are not damaged or folded by the forward side end portion of the edge section 39.

When the sheet sub-stack 4 is raised as described above, the arm 18 of the level detecting means 15 having the roller 23 in contact with the sheet sub-stack 4 via the upper protective sheet 5 is swung. The air cylinder 22 is controlled by the photoelectric device as described above to adjust the arm 18 so that the arm 18 is set to a predetermined swinging position, and stopped when the arm 18 is adjusted to the predetermined swinging position. After the arm 18 is thus adjusted to the predetermined swinging position, the level of the upper surface of the upper protective sheet 5 of the sheet sub-stack 4 can be detected by detecting the length of projection of the piston rod 22*a* of the air cylinder 22 by use of the rod length detecting device 27. The thickness of the sheet sub-stack 4 comprising the sheets in a predetermined number corresponding to the packaging unit and two protective sheets 5 is constant. Therefore, when the level of the upper surface of the upper protective sheet 5 of the sheet sub-stack 4 is detected, it is possible to find the level of the lower surface of the lower protective sheet 5 of the sheet sub-stack 4.

The raising member driving device 29 vertically moves the sheet sub-stack raising member 28 in the retracted position spaced from the stack 3 according to a signal S representing the level of the lower surface of the lower protective sheet 5 of the sheet sub-stack 4, and adjusts the sheet sub-stack raising member 28 to a level standing face to face with the space under the raised sheet sub-stack 4. Thereafter, the raising member driving device 29 moves the sheet sub-stack raising member 28 adjusted to the aforesaid level forwardly in an approximately horizontal direction until the forward end portion of the sheet sub-stack raising member 28 is inserted under the sheet sub-stack 4 of the stack 3. At this time, since the stack 3 is held from above thereof by the sheet sub-stack holding-down means 6 as described above, the sheet sub-stack 4 does not deviate in position of the remaining sheet sub-stacks of the stack 3 even though it is contacted by the forwardly moving sheet sub-stack raising member 28.

When the sheet sub-stack raising member 28 is inserted under the sheet sub-stack 4 as described above, it is advantageous that the side end portion of the sheet sub-stack raising member 28 close to the auxiliary sheet sub-stack raising member 36 which raises the sheet sub-stack 4 be first inserted under the sheet sub-stack 4 and then the opposite side end portion of the sheet sub-stack raising member 28 be inserted thereunder by use of a link mechanism or the like. In this case, the sheet sub-stack raising member 28 can be inserted more smoothly into the stack 3.

After the sheet sub-stack raising member 28 is inserted under the sheet sub-stack 4, the raising member driving device 29 lifts the sheet sub-stack raising member 28 by a predetermined distance. As a result, the portion of the sheet sub-stack 4 on the side of the side end face *1a* of the stack 3 is raised by the sheet sub-stack raising member 28 to a large extent away from the sheets 1 under the sheet sub-stack 4. When the sheet sub-stack 4 is thus raised by the sheet sub-stack raising member 28, the sheets 1 and the protective sheets 5 of the sheet sub-stack 4 are bent so that they are concave to the upper side. However, since the lower portion of the end face 14*a* of the rubber piece 14 secured to the holding-down member 11 has the convexly curved shape as described above, the sheets 1 and the protective sheets 5 of the sheet sub-stack 4 are not creased or damaged.

After the sheet sub-stack 4 is raised by the sheet sub-stack raising member 28 as described above, the grasping means driving device 35 is activated to move down the sheet sub-stack grasping means 32 from the stand-by position to the lower position where the spaces between the claw members 30*a*, 31*a* and the chuckers 33, 34 of the fingers 30, 31 stand face to face with the raised end portion of the sheet sub-stack 4. (Since the level of the raised end portion of the sheet sub-stack 4 is determined by the level of the sheet sub-stack raising member 28, the sheet sub-stack grasping means 32 can be correctly adjusted to the level as described above by adjusting the sheet sub-stack grasping means 32 to a predetermined level with respect to the sheet sub-stack raising member 28.) Thereafter, the sheet sub-stack grasping means 32 is moved forwardly in an approximately horizontal direction until the sheet sub-stack 4 enters into the spaces between the claw members 30*a*, 31*a* and the chuckers 33, 34 of the fingers 30, 31. The chuckers 33 and 34 of the sheet sub-stack grasping means 32 are then moved down, and the end portion of the sheet sub-stack 4 is grasped between the chuckers 33, 34 and the claw members 30*a*, 31*a*. When the sheet sub-stack grasping means 32 is moved down to grasp the sheet sub-stack 4 as described above, the lower portions of the fingers 30 and 31 are respectively inserted into the apertures 28*a* and 28*b* of the sheet sub-stack raising member 28 which raises the end portion of the sheet sub-stack 4, and therefore the downward movement of the sheet sub-stack grasping means 32 is not obstructed by the sheet sub-stack raising member 28.

After the end portion of the sheet sub-stack 4 is grasped by the chuckers 33, 34 and the claw members 30*a*, 31*a* as described above, the air cylinder 7 of the sheet sub-stack holding-down means 6 is activated to contract the piston rod 7*a*, and the holding-down of the stack 3 by the holding-down member 11 is released. Since the end portion of the sheet sub-stack 4 is grasped by the sheet sub-stack grasping means 32 as described above, the orderly arrangement of the sheets 1 constituting the sheet sub-stack 4 is not disturbed even when the holding-down of the stack 3 by the holding-down member 11 is released. The sheet sub-stack raising member 28 is then swung downwardly as indicated by the arrow C in FIG. 1, so that the sheets 1 of the stack 3 under the sheet sub-stack 4 are held down by the forward end portion of the sheet sub-stack raising member 28. When the sheets 1 under the sheet sub-stack 4 are held down and clamped, the sheet sub-stack grasping means 32 which grasps the sheet sub-stack 4 is then moved rearwardly, i.e. rightwardly of FIG. 1 to move the sheet sub-stack 4 onto a conveying means such as a roller conveyor positioned at the rear of the sheet sub-stack raising member 28. Then, the chuckers 33 and 34 of the sheet sub-stack grasping means 32 are moved up to release the grasping of the sheet sub-stack 4. the sheet sub-stack 4 separated from the stack 3 is thus moved to the conveying means and fed thereby to the next packaging process.

In the aforesaid embodiment, the auxiliary sheet sub-stack raising member 36 is used to facilitate the insertion of the sheet sub-stack raising member 28 into the stack 3 by slightly raising the sheet sub-stack 4 before the sheet sub-stack raising member 28 is inserted under the sheet sub-stack 4. However, instead of installing the auxiliary sheet sub-stack raising member 36, the sheet sub-stack 4 may be manually raised by the operator to some extent to facilitate the insertion of the sheet sub-stack raising member 28 into the stack 3.

Also, in the aforesaid embodiment, two protective sheets 5 are positioned for each predetermined number of sheets 1 to protect the upper and lower surfaces of each sheet sub-stack 4. However, it should be understood that the apparatus for separating and feeding sheet sub-stacks in accordance with the present invention can be applied also for a stack of sheet materials having no protective sheet.

Further, as the device for detecting the level of the sheet material in a predetermined position as numbered consecutively from the uppermost sheet material of the stack 3, it is also possible to use any known device other than the level detecting means 15 used in the aforesaid embodiment. However, the level detecting means 15 is advantageous in that it can be adjusted readily to cope with a change in thickness of the sheet sub-stack by adjusting the length of the portion of the roller shaft 17 projected from the end of the arm 18 when the thickness of the sheet sub-stack is changed due to a change in the number of sheets constituting the sheet sub-stack or ambient moisture absorption of the protective sheets.

I claim:

1. An apparatus for separating and feeding sheet sub-stacks which comprises:

(i) a sheet sub-stack holding-down means for holding a stack of sheets, which are independently laid one upon the other, from above said stack at a position spaced inwardly from a side end face of said stack, (ii) a level detecting means for detecting the level of a sheet in a predetermined position as numbered consecutively from the uppermost sheet of said stack, (iii) a sheet sub-stack raising member positioned in face-to-face relation to said side end face of said stack for movement in an approximately horizontal direction between an intervening position where it intervenes in said stack and a retracted position away from said stack and for movement in the vertical direction, (iv) a sheet sub-stack grasping means for grasping a predetermined number of said sheets as one sub-stack from the side of said side end face of said stack, said sheet sub-stack grasping means being capable of moving in the vertical direction and in an approximately horizontal direction, (v) a raising member driving device for adjusting the level of said sheet sub-stack raising member in said retracted position so that said sheet sub-stack raising member stands face to face with a space between said sheet in said predetermined position as numbered consecutively from the uppermost sheet of said stack, which is detected by said sheet level detecting means, and the sheet under said sheet in said predetermined position, for feeding said sheet sub-stack raising member in an approximately horizontal direction up to said intervening position, for lifting up said sheet sub-stack raising member by a predetermined distance in said intervening position, and for then moving down said sheet sub-stack raising member to a position for holding down the sheet under said sheet in said predetermined position, (vi) a grasping means driving device for moving said sheet sub-stack grasping means to a position for grasping a side end portion of the sheet sub-stack comprising the predetermined number of said sheets, said side end portion being raised by said sheet sub-stack raising member on the side of said side end face of said stack, for causing said sheet sub-stack grasping means to grasp said side end portion of said sheet sub-stack, and for then moving said sheet sub-stack grasping means in an approximately horizontal direction to separate said sheet sub-stack from the upper section of said stack, and (vii) a sheet sub-stack holding-down means controlling device for adjusting said sheet sub-stack holding-down means to a stack holding-down position at least as long as said sheet sub-stack raising member is moved in contact with said stack.

2. An apparatus as defined in claim 1 wherein said sheet sub-stack holding-down means comprises an air cylinder vertically positioned with a piston rod thereof facing down, and a holding-down member supported on the end of said piston rod via shock-absorbing springs.

3. An apparatus as defined in claim 2 wherein said holding-down member is provided at the bottom thereof with a resilient material having an end face the lower portion of which is curved convexly.

4. An apparatus as defined in claim 1 wherein said sheet level detecting means comprises an arm adapted for swinging around a supporting point secured to a plate and provided with a roller shaft suppported at an end portion of said arm, and an air cylinder having a piston rod, said plate being supported on the lower end of said piston rod.

5. An apparatus as defined in claim 4 wherein a roller is supported on the lower end of said roller shaft, and said sheet level detecting means is positioned such that said roller contacts a corner portion of the top surface of said stack by the weight of said roller.

6. An apparatus as defined in claim 4 wherein said end portion of said arm is provided with a clamp member for adjusting the length of the portion of said roller shaft downwardly projected from said end portion of said arm.

7. An apparatus as defined in claim 4 wherein said plate and said arm are respectively provided with a light projector and a light receiver constituting members of a photoelectric device for detecting a predetermined swinging position of said arm.

8. An apparatus as defined in claim 4 wherein said sheet level detecting means is connected to a rod length detecting device for detecting the length of projection of said piston rod.

9. An apparatus as defined in claim 1 wherein said sheet sub-stack raising member is provided with a forward end portion bent downwardly and apertures positioned in the vicinity of said forward end portion for allowing said sheet sub-stack grasping means to enter said apertures.

10. An apparatus as defined in claim 1 wherein said sheet sub-stack grasping means comprises fingers respectively provided at their lower end portions with claw members facing said stack and with chuckers standing face to face with said claw members from above thereof, said chuckers being adapted for vertical movement with respect to said claw members.

11. An apparatus as defined in claim 1 further comprising an auxiliary sheet sub-stack raising member positioned in face-to-face relation to a corner portion of said stack on the lateral side of said sheet sub-stack raising member and comprising a base section provided with a handle secured to a side portion thereof, an approximately L-shaped edge section having a rear end portion secured to a forward end portion of said base section and a forward end portion facing the center of said stack, and driving means for moving said auxiliary sheet sub-stack raising member vertically and approximately horizontally.

12. An apparatus as defined in claim 11 wherein said edge section houses a compressed-air pipe provided at the forward end thereof with a nozzle for jetting compressed air from said forward end portion of said edge section to the center of said stack.

* * * * *